US005209299A

United States Patent [19]

Ayres

[11] Patent Number: 5,209,299

[45] Date of Patent: May 11, 1993

[54] MULTIPLE CHAMBER CHEMICAL INJECTION SYSTEM

[76] Inventor: Robert N. Ayres, 142 S. Cocren's Green Cir., The Woodlands, Tex.

[21] Appl. No.: 830,606

[22] Filed: Feb. 4, 1992

[51] Int. Cl.[5] ..... E21B 37/06

[52] U.S. Cl. ..... 166/305.1; 166/90; 166/902

[58] Field of Search ..... 166/305.1, 307, 75.1, 166/90, 902, 91, 53

[56] References Cited

U.S. PATENT DOCUMENTS

| | | | |
|---|---|---|---|
| 1,645,686 | 10/1927 | Brady . | |
| 2,752,067 | 6/1956 | Kohl et al. | 222/811.5 |
| 2,801,697 | 8/1957 | Rohrback | 166/1 |
| 2,884,067 | 4/1958 | Marken | 166/75 |
| 3,700,031 | 10/1972 | Germer, Jr et al. | 166/305.1 |
| 4,390,061 | 6/1983 | Short | 166/372 X |
| 4,436,148 | 3/1984 | Maxwell | 166/53 |
| 4,582,131 | 4/1986 | Plummer et al. | 166/68 |
| 4,593,763 | 6/1986 | Burke | 166/302 |
| 4,796,697 | 1/1989 | Ayres | 166/310 |
| 4,830,112 | 5/1989 | Erickson | 166/902 X |
| 4,896,726 | 1/1990 | Ayres | 166/312 |

OTHER PUBLICATIONS

Containment Incorporated, "Spilguard System 55 & System 80".

*Primary Examiner*—William P. Neuder

[57] ABSTRACT

An apparatus and method for injecting chemicals into a hydrocarbon producing well is disclosed. The invention includes a vessel which is divided with a baffle into a first chamber and a second chamber. The chemical is installed in the first chamber, and a pressurized gas is injected in the second chamber. A valve is connected to the first chamber to selectively control the injection of chemical into the well as the pressurized gas urges the baffle to pressurize the chemical within the first chamber.

20 Claims, 1 Drawing Sheet

MULTIPLE CHAMBER CHEMICAL INJECTION SYSTEM

FIELD OF THE INVENTION

The present invention relates to an improved apparatus and method for injecting chemicals into a hydrocarbon producing well. More particularly, the present invention relates to a pressure vessel which contains the chemical and a pressurized gas which urges the chemical from the vessel and into the hydrocarbon producing well.

BACKGROUND OF THE INVENTION

In the production of oil, gas and other hydrocarbons, a tubing string is often positioned within the well casing. The hydrocarbons enter the tubing through perforations located at the lower end of a tubing string. In some wells, the hydrocarbons are pumped to the surface with a sucker rod pump located on the surface or with a downhole submersible pump. At the well surface, production equipment directs the hydrocarbon fluids to holding tanks or to a pipeline. The well production equipment typically comprises tubing, valves, piping, and other components.

The hydrocarbon fluids contain numerous compounds which adversely affect the well production equipment. For example, paraffins and water/oil emulsions can coat the well production equipment and eventually plug perforations in the tubing. In addition, chemical reactions between the hydrocarbon fluids and metallic equipment can cause scale to be formed on the well production equipment, and corrosive compounds in the hydrocarbon fluids can physically corrode the well production equipment.

Various techniques can treat these well conditions to extend the useful life of the well production equipment. In wells susceptible to paraffin build-up, "treater trucks" are regularly dispatched to pump hot oil into the well. The hot oil enters the casing, melts the paraffin deposits in the well production equipment, and returns to the surface through the tubing. For wells susceptible to corrosion and scale problems, high pressure injection trucks pump batches of chemicals into the well to chemically remove the scale, and to inhibit the causes of corrosion. All of these practices require regular maintenance services which are costly and which do not continuously treat the well. Batch treatment of wells is less efficient than continuous treatment because more chemicals are typically injected in batch treatment operations.

To avoid inefficiences associated with treater truck maintenance of hydrocarbon producing wells, well operators use mechanical pumps to inject chemicals into a well. Typically, the mechanical pumps are supplied from a storage tank which holds the chemicals. The mechanical pumps and storage tanks are located adjacent the well for several reasons, such as for reducing the length on the power cable connected to the pump. The tanks are located above the pump and the chemical is gravity fed to the intake port of the pump. These tanks include a vent at the upper end of the tank to prevent a vacuum from developing in the tank as the pump draws chemical from the tank. In addition, the vent releases excess pressure within the tank caused by thermal expansion of the chemical. Such thermal expansion can cause the chemical vapors to be released into the environment through the vent. In addition, thermal expansion can cause the chemical to be ejected through the vent or through the sight glass used to indicate the chemical level in the tank. In either event, chemical vapors or the chemical fluids are released in an uncontrolled manner and can pose a hazard to personnel and to the environment.

The mechanical pumps used in chemical injection systems are powered by electricity or gas and include numerous moving components. It is customary to inspect these pumps on a regular basis, sometimes daily, to verify the operability of the pumps. Because the chemical is gravity fed to the intake of the chemical pump, sediment in the tank or the chemical settles toward the pump intake and can interfere with the operation of the pump. In addition, the presence of an air bubble in the intake line can impede the operation of the pump because of a vapor lock. In such event, maintenance personnel routinely open a bleeder valve on the pump and release chemical from the pump until the air bubble has been cleared. This practice is undesirable because it releases chemical into the environment.

Presently available systems contain moving components which are subject to failure and require regular maintenance. Such systems are also undesirable because they vent chemicals into the environment. Accordingly, a need exists for a system which injects chemicals into a hydrocarbon producing well without moving components and without releasing the chemicals into the environment.

SUMMARY OF THE INVENTION

The present invention overcomes the limitations of the prior art by disclosing a closed system which can inject chemicals into a hydrocarbon producing well without using moving equipment. The invention comprises a vessel having a movable baffle which defines a first chamber and a second chamber. A chemical is contained in the first chamber and a pressurized gas is contained in the second chamber. A valve is connected to the first chamber of the vessel for selectively controlling the flow of the chemical into the well. As the valve is operated, the pressurized gas moves the baffle to pressurize the chemical and to cause the chemical to exit the first chamber and to enter the well.

DESCRIPTION OF THE PREFERRED EMBODIMENTS

Figure 1:
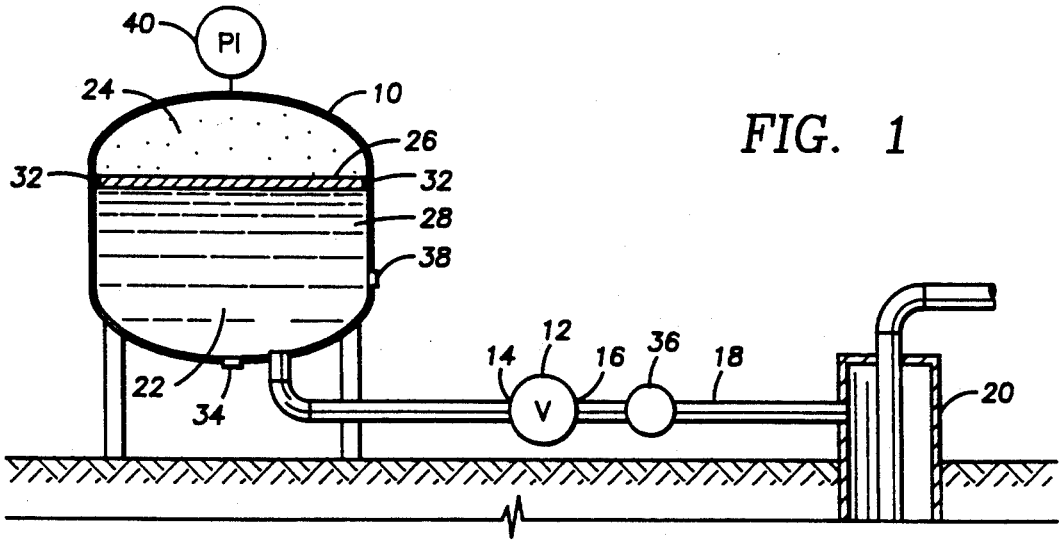
FIG. 1 illustrates a schematic view of the vessel, a linearly movable baffle separating the first and second chambers, and a valve for controlling the flow of chemical into the well.

The present invention overcomes the limitations of the prior art by providing a unique apparatus and method for injecting a chemical into a hydrocarbon producing well. Referring to FIG. 1, vessel 10 comprises a container which is capable of holding an internal pressure without failure. Vessel 10 is distinguishable from containers such as tanks which are only designed to withstand the hydrostatic pressure exerted by the fluid in the tank. Preferably, vessel 10 is constructed from a fiberglass, stainless steel, epoxy resin, or other material which is resistant to degradation induced by chemicals and corrosive gases. Alternatively, vessel 10 can be constructed from a material which is coated with an inner lining (not shown) resistant to corrosion.

Valve 12 is attached to the lower end of vessel 10 and has an inlet end 14 in fluid communication with vessel 10. Valve 12 can comprise a micrometering valve which is adjustable to increase or decrease the flow rate. Outlet end 16 of valve 12 is connected to one end of fluid line 18, and the other end of fluid line 18 is attached to well 20. In another embodiment, fluid line 18 is connected between vessel 10 and well 20, and valve 12 is in fluid communication with fluid line 18. A filter (not shown) can be installed in line 18 to prevent solid particles in chemical 22 from contaminating valve 12. In another embodiment, line 18 can be connected to the lower end of vessel 10 and can rise upwards so that gravity acts against solid particles in chemical 22 to prevent the solid particles from entering valve 12.

Although well 20 can comprise a hydrocarbon producing well, the present invention is useful in other wells relating to the production of hydrocarbons such as injection wells used in enhanced recovery operations. As used throughout this disclosure, the terms "well" and "hydrocarbon producing well" will include all wells directly or incidentally associated with the production or injection of fluids containing hydrocarbons.

Chemical 22 and pressurized gas 24 are located in vessel 10 and are separated by baffle 26. Baffle 26 is shown as dividing vessel 10 into a first chamber 28 for containing chemical 22 and into a second chamber 30 for containing pressurized gas 24. As contemplated by the present invention, chemical 22 can comprise any liquid compound or material to be injected into a hydrocarbon producing well. As representative examples, without limiting the scope of the invention, chemical 22 can comprise chemicals generally identified as scale inhibitors, water clarifiers, demulsifiers, and other chemicals which inhibit the formation of chemical and metallic compounds in hydrocarbon producing wells. Pressurized gas 24 may comprise readily available gases such as nitrogen, helium, argon, or carbon dioxide. Pressurized gas 24 may be retained at a pressure which is less than or greater than the liquification pressure for such gas.

Referring to FIG. 1, baffle 26 is linearly movable within the interior of vessel 10. As chemical 22 is removed from first chamber 28, baffle 26 decreases the size of first chamber 28 while simultaneously increasing the size of second chamber 30. This occurs because of the pressure exerted on baffle 26 by pressurized gas 24. Seal 32 is in contact with the interior of vessel 10 to prevent pressurized gas 24 from entering first chamber 28, and to prevent chemical 22 from entering second chamber 30.

In operation, valve 12 is initially closed to prevent the release of chemical 22 from vessel 10. Valve 12 is then selectively opened and pressurized gas 24 acts on baffle 26 to urge chemical 22 through valve 12, through line 18, and into well 20. Preferably, valve 12 is adjustable to selectively control the flow of chemical into well 20. Valve 12 can be set to selectively adjust the flow rate into well 20, and to increase or decrease the flow rate of such chemical. This feature is an important feature of the present invention, since the precise injection rate of chemical 22 accomplishes several objectives Certain wells require large volumes of chemicals to accomplish the desired function. Other wells require only relatively small quantities of chemicals to accomplish the desired results. For example, certain wells may require only a fraction of a gallon per day to accomplish the desired result, and the injection of additional chemicals is unnecessary to the operation of the well. If more chemical than required is injected into the well, then the excess chemical is superfluous to the operation of the well and results in additional cost to the operator. The present invention accomplishes this desired result by selectively controlling the flow rate of the chemical and by preventing higher than required flow of chemical.

The present invention can be adjusted to control the flow of chemical in several different ways. In one embodiment of the invention, valve 12 continuously permits chemical 22 to exit vessel 10 and to enter well 20. In another embodiment, valve 12 can be configured to selectively permit a selected quantity, or batch, of chemical 22 into well 20. This batch feature can be accomplished by a timer mechanism (not shown) or mechanical device incorporated into valve 12 through techniques well-known in the art. The continuous feed embodiment will improve the performance of certain chemical treatments over batch treatment, as it permits the continuous treatment of the well at all times during operation of the well. In certain applications, continuous treatment will prevent corrosion or paraffin buildup before the corrosion or paraffin buildup begins to affect the performance of the downhole well equipment.

Referring to FIG. 1, check valve 36 is installed in line is to prevent fluids in well 20 from back flowing into vessel 10. This feature is desirable because a well operator could accidentally pressurize well 20 to a pressure higher than that of chemical 22 in first chamber 28. Alternatively, this check valve function could be incorporated into the design of valve 12. In addition, chemical inlet 34 is located in first chamber 28 to permit the injection of chemical 22 into vessel 10. During such refilling, chemical 22 should be injected under pressure into first chamber 28. This injection under pressure is necessary to overcome the pressure exerted by pressurized gas 24. As chemical 22 in injected into first chamber 28 through inlet 34, the volume of first chamber 28 increases while the volume of second chamber 30 simultaneously decreases. This procedure to refill chemical 22 moves baffle 26 and increases the pressure of pressurized gas 24.

Sensor 38 can be located in first chamber 28 to detect or indicate the quantity of chemical 22 in first chamber 28. Sensor 38 can also comprise any mechanical, electrical, electronic, or other apparatus which is capable of detecting the level of chemical 22 in first chamber 28. Guage 40 can be connected to second chamber 30 to detect the pressure of pressurized gas 24.

Figure 2:
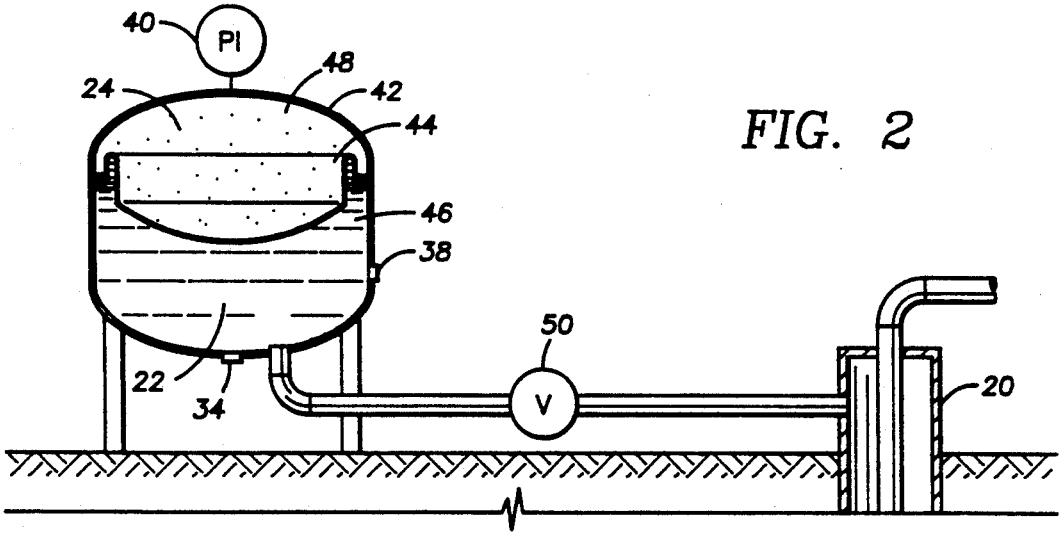
FIG. 2 illustrates a schematic view of an alternative embodiment of the invention showing a expandable baffle.

Referring to FIG. 2, vessel 42 includes an expandable baffle 44 which divides vessel 42 into first chamber 46 and second chamber 48. Chemical 22 is installed into first chamber 46 and pressurized gas 24 is injected into second chamber 48. Valve 50 selectively permits chemical 22 to exit first chamber 46 and to enter well 20. Simultaneously, the pressure of pressurized gas 24 expands baffle 44 to reduce the volume of first chamber 46 and to urge chemical 22 toward valve 50 as previously described. Baffle 44 can be constructed from any expandable material such as elastomers and rubber which flexes without permitting pressurized gas 24 from contacting chemical 22.

Figure 3:
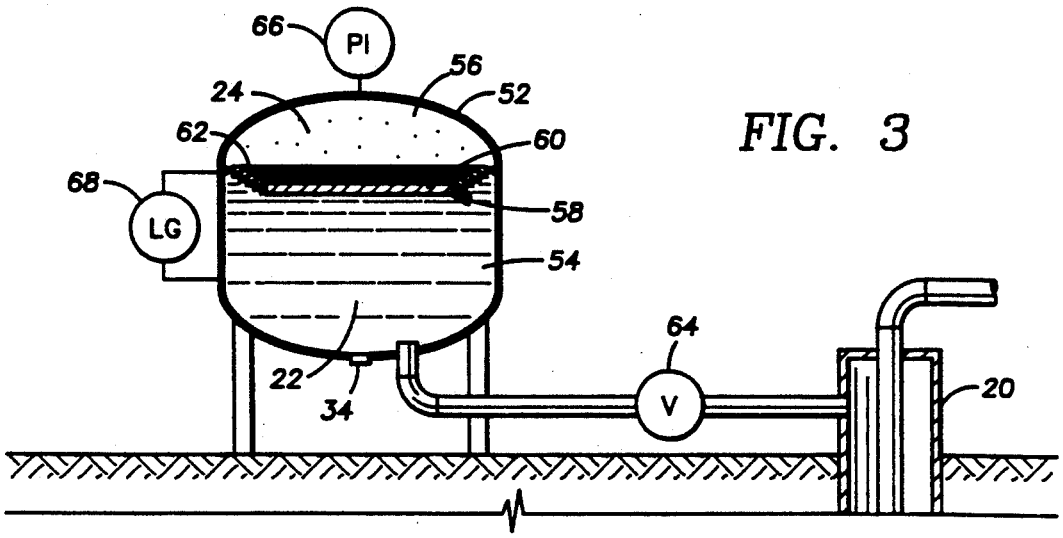
FIG. 3 illustrates a schematic view of an alternative embodiment of the invention showing a baffle which has a rigid center by a flexible seal to the interior of the vessel.

Referring to FIG. 3, vessel 52 is divided into first chamber 54 and second chamber 56 by baffle 58 Baffle 58 is comprised of frame 60 and seal 62. Frame 60 is movable within the interior of vessel 52 and is attached by seal 62 to the interior of vessel 52. Seal 62 can comprise any suitable flexible material such as plastics, elastomers, and metals. Chemical 22 is installed in first chamber 54, and pressurized gas 24 is injected into second chamber 56 in a manner previously described. Valve 64 selectively permits chemical 22 to exit first chamber 54 and to enter well 20. As chemical 22 exits first chamber 54, the pressure of pressurized gas 24 causes baffle frame 60 to decrease the volume of first chamber 54 and to urge chemical 22 toward valve 64.

Referring to FIG. 3, pressure guage 66 is attached to vessel 10 to measure the pressure of pressurized gas 24. Guage 68 is attached to vessel 10 for measuring the quantity of chemical 22 in first chamber 28. Guage 68 can comprise many different embodiments such as sight glasses, electromagnetic switches, and other devices well-known in the art. In addition, guage 34 could comprise a flow meter which measures the quantity of fluid flowing from vessel 10. When the fluid flowing from vessel 10 is compared to the quantity of chemical 22 installed in vessel 10, the quantity of chemical 22 in first chamber 28 at any point in time can be determined.

The present invention provides a novel method of injecting chemical into a hydrocarbon producing well. The invention controls the rate of chemical injection and can be adjusted to inject chemicals at large or small flowrates. The chemical is injected without the need for pumps or other mechanical devices which require maintenance and are subject to operational failure. The invention uniquely prevents the discharge of the chemical or pressurized gas into the environment by disclosing a closed injection system which does not contain vents and does not permit chemical releases into the environment. Because the system is closed, aromatic compounds in the chemical are not vented to the environment. The absence of a vent further reduces the risk of fires due to flammable chemicals and reduces the contact between chemical vapors and well personnel. Moreover, the invention permits the continuous injection of chemicals into the well on a fulltime basis, and thereby prevents corrosion or undesirable deposits from accumulating in the well.

The present invention is particularly useful in remote or environmentally hostile applications. The absence of moving components reduces the maintenance required for the chemical injection system, in contrast to the regular care necessary for chemical pumps. Because the chemical is pressurized within the vessel, pressure changes in the chemical due to variations in the ambient temperature will be less significant that if the chemical was contained by an unpressurized storage tank. Consequently, the present invention is readily adaptable to offshore, arctic and tropical environments. In offshore platforms, the invention furnishes significant flexibility in the deck location of the vessel. In arctic environments subject to intense cold, antifreeze can be blended with the chemical to prevent icing in the valve, pressure regulator, and flow lines. In arctic or tropical environments, it may be desirable to insulate certain components of the invention to minimize the effects of temperature extremes. The pressurized gas can further be used to automatically inflate balloons or markers connected to a vessel for supporting a vessel displaced into the water from an offshore platform, or for identifying the location of the vessel after it has been otherwise displaced from a well site.

The embodiments of the invention shown herein are illustrative only and do not limit the scope of the invention. It will be appreciated that numerous modifications and improvements may be made to the inventive concepts herein without departing from the scope of the invention.

What is claimed is:

1. An apparatus for selectively injecting a chemical into a well, comprising:

a pressure vessel having a movable baffle defining a first chamber for holding the chemical and defining a second chamber separated from said first chamber, wherein said pressure vessel is closed to atmospheric pressure;

a valve in fluid communication with said first chamber and with the well for selectively permitting the chemical to exit said first chamber; and a pressurized gas located in said second chamber for moving said baffle to pressurize the chemical, thereby causing the chemical to exit said first chamber through said valve and to enter the well.

2. An apparatus as recited in claim 1, wherein said baffle is substantially rigid and is linearly movable within said pressure vessel as said pressurized gas urges said baffle into contact with the chemical.

3. An apparatus as recited in claim 1, wherein said baffle is deformable by the pressure induced by said pressurized gas.

4. An apparatus as recited in claim 3, wherein said baffle is elastically deformable by the pressure of said pressurized gas, as the chemical exits said pressure vessel, to increase the volume of said second chamber as the volume of said first chamber is decreased.

5. An apparatus as recited in claim 1, wherein said baffle prevents said pressurized fluid from exiting said pressure vessel.

6. An apparatus as recited in claim 1, further comprising means for indicating the quantity of chemical in said pressure vessel.

7. An apparatus as recited in claim 2, further comprising means for indicating the location of said baffle within said pressure vessel.

8. An apparatus as recited in claim 1 further comprising a pressure guage attached to said pressure vessel for measuring the pressure of said pressurized gas in said pressure vessel.

9. An apparatus as recited in claim 1, wherein said pressurized gas is held at a selected pressure so that at least a portion of said pressurized gas is in a liquid state.

10. An apparatus as recited in claim 1, further comprising means for injecting the chemical into said first chamber.

11. An apparatus for selectively injecting a chemical into a well, comprising:

a pressure vessel closed to atmospheric pressure;

a baffle comprising a rigid member and a seal between said rigid member and the interior wall of said pressure vessel, wherein said baffle defines a first chamber within said pressure vessel which is segregated from a second chamber within said pressure vessel;

means for installing the chemical within said first chamber of said pressure vessel;

a pressurized gas within said chamber of said pressure vessel for moving said baffle to pressurize the chemical within said first chamber; and a valve in fluid communication with said first chamber and the well for selectively controlling the flow of chemical from said first chamber and into the well as said pressurized gas moves said baffle.

12. An apparatus as recited in claim 11 wherein said seal is fastened to the interior of said pressure vessel.

13. An apparatus as recited in claim 11, wherein said seal is in sliding engagement with the interior of said pressure vessel.

14. An apparatus as recited in claim 11, further comprising a pressure regulator in fluid communication with said valve for controlling the pressure of the chemical.

15. An apparatus as recited in claim 11, further comprising a first pressure regulator in fluid communication between said valve and said first chamber, and a second pressure regulator in fluid communication between said valve and the well.

16. An apparatus as recited in claim 11, further comprising means for indicating the quantity of chemical in said first chamber.

17. An apparatus as recited in claim 11, wherein said valve is capable of distributing the chemical to at least two wells.

18. A method for injecting a chemical into a well, comprising the steps of:

installing a quantity of chemical into the first chamber of a pressure vessel having a movable baffle which separates said first chamber from a second chamber, wherein said pressure vessel is closed to atmospheric pressure;

injecting a pressurized gas into said second chamber of said pressure vessel so that the pressure induced by said pressurized gas urges said baffle toward the chemical; and operating a valve in fluid communication between said first chamber and the well for selectively controlling the flow of the chemical from said first chamber and into the well as said pressurized gas urges said baffle toward the chemical.

19. A method as recited in claim 18, further comprising the step of controlling the pressure of the chemical with a pressure regulator in fluid communication with said valve.

20. A method as recited in claim 18, further comprising the step of measuring the quantity of chemical within said first chamber.

* * * * *